United States Patent [19]

Kiester

[11] Patent Number: 4,505,057

[45] Date of Patent: Mar. 19, 1985

[54] SKI BOOT SOLE EXTENSION

[76] Inventor: Phillip D. Kiester, 781 W. San Bernardino, Covina, Calif. 91722

[21] Appl. No.: 490,048

[22] Filed: Apr. 29, 1983

[51] Int. Cl.[3] ..... A43B 5/04

[52] U.S. Cl. ..... 36/117; 36/132

[58] Field of Search ..... 36/117–121, 36/132, 25 R; 12/120.5

[56] References Cited

FOREIGN PATENT DOCUMENTS

| | | | |
|---|---|---|---|
| 2506751 | 8/1976 | Fed. Rep. of Germany | 36/117 |
| 2835779 | 3/1979 | Fed. Rep. of Germany | 36/132 |
| 2746052 | 4/1979 | Fed. Rep. of Germany | 36/132 |
| 2917542 | 11/1980 | Fed. Rep. of Germany | 36/117 |
| 2376636 | 8/1978 | France | 36/117 |

*Primary Examiner*—James Kee Chi

*Attorney, Agent, or Firm*—Hubbard and Stetina

[57] ABSTRACT

A ski boot having a curved bottom which includes four portions defining, during walking, a unique path for the force vector of the user's weight as the user walks and having defined angular and special relationships which make walking in a ski boot easier, safer and move convenient is described.

14 Claims, 10 Drawing Figures

Fig. 6
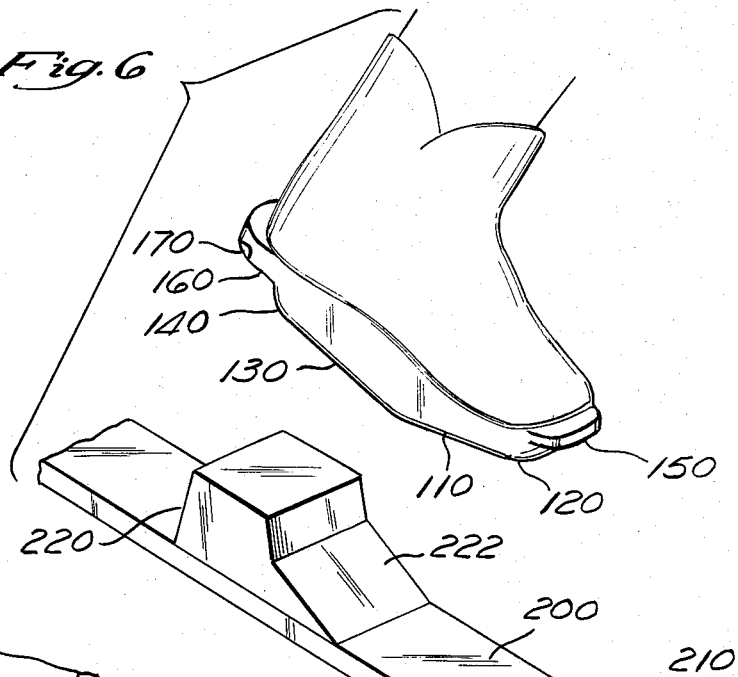
Fig. 7
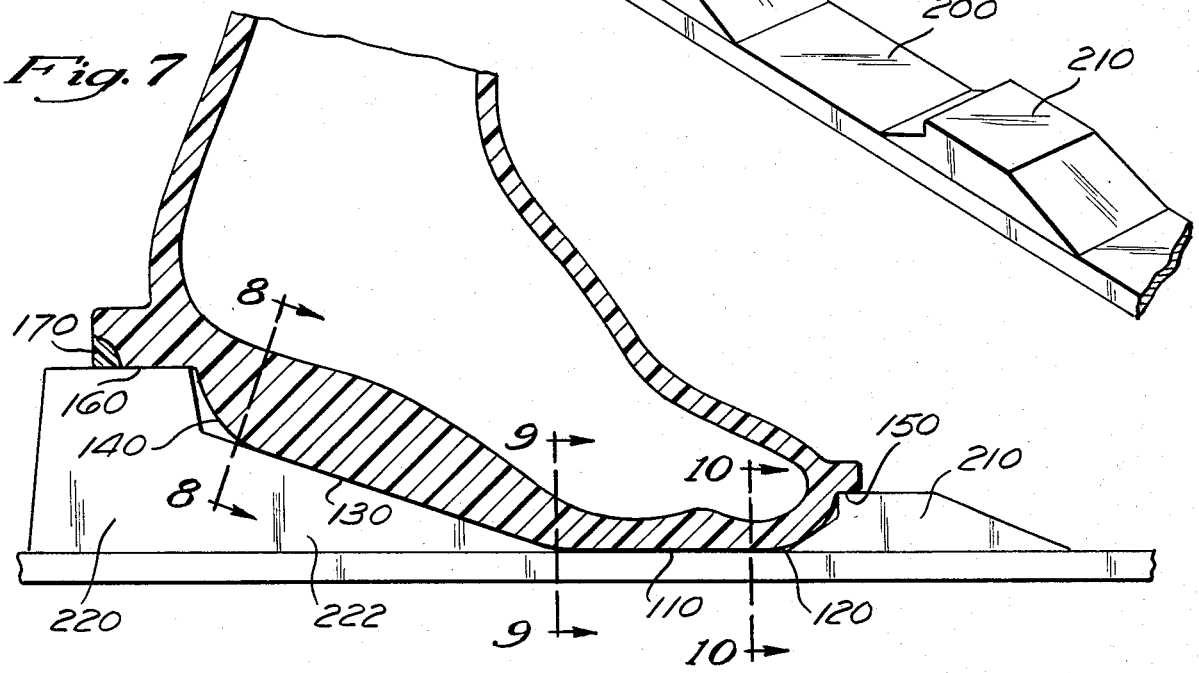
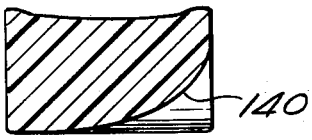
Fig. 8
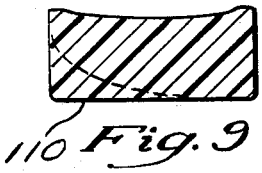
Fig. 9
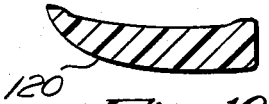
Fig. 10

SKI BOOT SOLE EXTENSION

FIELD OF THE INVENTION

This invention relates to ski boots, and to attachments or extensions for ski boots, specifically designed to permit the user to wear the ski boot while skiing and also to use the ski boot while walking, obviating the existing problems with ski boots during walking.

BACKGROUND

Over the past twenty years, it has been discovered that an active and mobile ankle hinders the art of skiing, because the ankle is not designed to control the massive forces created by the long lever-arms of the skis. The problem has been solved with the high-top ski boot which has totally immobilized the foot and ankle. Recent improvements have served to eliminate the last vestiges of motion of the skier's foot. The results have been wonderful on the slopes with the skis on, but walking in these ski boots has presented very serious problems and disadvantages. The present invention is directed to an improvement in the sole construction, or adaptation for use with a sole construction, of the type of ski boots just referred to which maintains solid fixation of the foot and ankle.

The tibio-talar joints and subtalar joints, together comprising what is commonly known as the ankle joint, in man performs three functions. They allow for controlling the absorption of impact after heel-strike. They allow for the advancement and rotation of the leg without the foot having to slide, or leave the floor, and allow the body weight to rest over the most stable, strongest of the foot during rest. The functions of the ankle, the foot, the lower leg and the knee, and various particular structures within these members are discussed as they relate to the design of the subject invention. In this discussion, the following terms are used and have the definition given below:

Contact Point: The contact point, as you see here, is the point of initial contact during normal walking, used at the rear most tip of the heel.

Resting Surface: The resting surface of the boot, or the boot sole, is that portion which is in contact with the floor or ground during normal standing. (The terms floor and ground are used interchangeably throughout this specification and the claims to indicate a normal walking surface, whether indoor or out, and include walking on snow, or in any other place where walking may occur.)

Incident Angle: The incident angle referred to hereinafter is the angle the leg makes to the floor during initial contact of the foot with the floor.

Center of the Knee: The center of the knee is the center of pressure for weight-bearing in the knee. The center of the knee is approximated by finding the center of the proximal end of the tibia.

Vector Point: The vector point is the center most point of the area in which force is exerted at any instant in time against the floor, resolved into a single vector with its origin upon the floor. In order for a man to stand, this vector must pass through a weight-bearing portion of the foot. The vector point is defined as the origin, on the floor, of this vector. During walking, of course, the vector point moves from the rear or posterior end of the sole to the front or anterior end of the sole as the foot rolls from the heel, upon striking, to the toe as the weight is transferred to the other foot.

Central Line: The central line is defined as an imaginary line passing perpendicular to the floor through the medial malleolus of the user's foot.

Medial: Medial and medially refer to the inside of the foot. Thus, the medial side of the right foot of the user would be on the left side of the foot whereas the medial side of the left foot of the user would be the right side of the foot.

Lateral: The terms lateral and laterally refer to the outside of the foot.

Malleolus: The malleolus is the outcropping which is commonly referred to as the ankle.

Segment: A segment, as used here, approximates about thirty percent of the length of the foot, but is defined as the distance from the heel of the user to the central line, as defined above.

Metatarsal: Metatarsal refers to the high metatarsal bones which form the skeleton of the foot which articulate with the tarsal bones and with each other proximally and distally, articulate with the proximal end of the phalanx. The metatarsal head is the enlarged portion of the foot where the metatarsal bones articulate with the phalanges.

Reference may be made to standard texts or treatise for other definitions of body structures. See, for example, HUMAN ANATOMY AND PHYSIOLOGY, Alexandra P. Spence and Elliott B. Mason, The Benjamin/Cummings Publishing Company, Inc. 1979.

There have been numerous attempts to solve the problem of walking in ski boots. Representative of these attempts are the structures disclosed in the following United States patents.

Booty U.S. Pat. No. 4,286,397, 9/1/1981
Brugger-Stuker U.S. Pat. No. 3,971,144, 7/27/1976
D'Alessandro et al U.S. Pat. No. 4,045,890, 9/6/1977
DeFever U.S. Pat. No. 4,156,316, 5/29/1979
Frey U.S. Pat. No. 4,199,880, 4/29/1980
Groves U.S. Pat. No. 4,228,602, 10/21/1980
Kastinger U.S. Pat. No. 4,194,309, 3/25/1980
Keller U.S. Pat. No. 4,294,025, 10/13/1981
Pasich U.S. Pat. No. 4,123,854, 11/7/1978
Sartor U.S. Pat. No. 4,291,473, 9/29/1981
Sturany U.S. Pat. No. 3,740,873, 6/26/1973
Viletto U.S. Pat. No. 4,261,114, 4/14/1981
Weninger U.S. Pat. No. 4,155,179, 5/22/1979
Woolley U.S. Pat. No. 4,160,301, 7/10/1979

The above patents disclose a great variety of attachments and modifications of ski soles and ski boot constructions designed to alleviate the difficulty in walking occasioned by the design of the ski boot which, of course, is designed primarily to be comfortable during skiing and to permit the skier maximum control of the skis. The Frey patent discloses an attachment for ski boots as do the patents to Booty, Groves, Woolley, DeFever, Pasich, D'Alessandro et al, Brugger-Stuker, Keller and Sturany. The patents to Sartor, Kastinger and Weninger, each discloses ski boots which have a portion which can be moved to provide a non-flat ski sole and the patent to Viletto discloses a ski boot with a sole which has a bendable portion formed therein.

While the problem of walking in ski boots is well recognized and while many efforts have been made to solve the problem, it does not appear that a solution has been found and a boot sole designed to meet the fundamental bases of the problem. Generally, the prior art has concentrated upon providing some kind of a walker device either built into or attached to the ski boot providing a higher center than ends, permitting the skier, the user, when he is walking to rock from one end of the boot to the other. No recognition of the actual rocking mechanism of the foot and angular relationships are shown to have been considered in these designs. It is an object of this invention to provide a ski boot with a sole extension, or a sole extension which is adapted to be associated with a ski boot, which is designed to permit the skier to walk comfortably and efficiently, with minimal unnatural movement of the legs, ankles and foot.

SUMMARY OF THE INVENTION

The present invention relates to a ski boot which has a specially designed body and sole construction. The ski boot of this invention comprises a body which has an upper surface configured to mate with the sole structure of the boot combined with a specially designed sole. The body is formed unitarily with the sole, the sole being elongate, having a length and a width generally corresponding to the length and width of the user's foot. The bottom of the sole is formed and configured into at least three, preferably four, portions. The first portion is adapted to rest on the top of the ski during skiing. The first portion is generally flat and lies under the metatarsal and partially under slightly up-turned toes of the user's foot. It may begin slightly posterior to the metatarsal head, when the user is skiing, and extends anterior thereto and may extend partially under the toes. The second portion slopes in a complex double arcuate or curved configuration, curving longitudinally and medially of the user's foot forwardly from the first portion and upperly toward the top of the boot toe. The third portion slopes in a generally flat configuration rearwardly from the first portion to at least a point approximately under the medial malleolus of the user's ankle. The fourth portion slopes in a double arcuate or curved configuration laterally of the user's foot and rearwardly thereof, toward the upper surface such that, in use, the fourth portion normally strikes the floor first when the user is walking. The four portions of the bottom form a continuous surface which is constructed and configured such that the user's foot rolls laterally on the fourth portion, after striking, to the third portion, whereupon it rolls along the third portion and then the first portion, generally centrally, and then rolls medially on the second portion as the user ends a stride.

The rear most end of the sole preferably lies approximately one-half the distance from the tip of the user's heel (the rear most point of the heel of the user when the boot is in use) to a point lying directly below the medial malleolus of the user's ankle.

The front most end of the first portion extends approximate a point approximately beneath the metatarsal head of the user's foot (when the boot and body are in use) to the anterior of the toe, and slightly beyond.

The first and third portions are, preferably, generally planar, though this is not critical, and intersect each other, the angle between the planes of the first and the third portions generally being from about five degrees to about fifteen degrees, usually in the range of about ten degrees. For certain professional skiers, this angle may be as high as twenty-five or even thirty degrees, but for most skiers, angle in the vicinity of about ten degrees plus or minus five degrees is preferred.

BRIEF DESCRIPTION OF THE DRAWINGS

FIG. 6 is an exploded view showing the relationship of the ski boot of this invention to a ski.

FIG. 7 is a side view showing the ski boot of this invention, in cross-section, as it would rest upon a ski.

FIG. 8 depicts a partial cross-section of the sole of the boot of this invention taken along lines 8—8 in the direction of the arrows as shown in FIG. 7.

FIG. 9 depicts a partial cross-section of the sole of the boot of this invention taken along lines 9—9 in the direction of the arrows as shown in FIG. 7.

FIG. 10 depicts a partial cross-section of the sole of the boot of this invention taken along lines 10—10 in the direction of the arrows as shown in FIG. 7.

DESCRIPTION OF THE PREFERRED EMBODIMENTS

Figure 1:
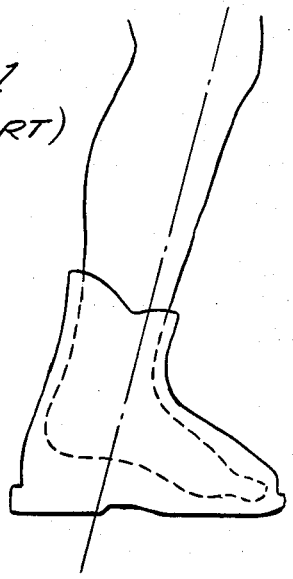
Fig. 1 (PRIOR ART)
FIG. 1 is a generalized depiction of a prior art ski boot worn by a wearer showing its position during walking.

A perpendicular drawn up from the floor, passing through the medial malleolus will roughly pass through the dome of the tallus. This is called the central line. The lateral malleolus is formed by the head of the fibula which is posterior to the dome of the tallus. This means that the dome of the tallus can be palpated laterally just anterior of the lateral malleolus. This is the lateral determiner for the central line.

If a person could balance their weight perfectly so that the vector point, the center of the knee and the medial malleolus were all on the central line, then no muscle action would be required or balance to be maintained. Normally, the vector point for standing falls anterior to this line, so that minor amounts of calf muscle tension are required for balance. By varying the tension in the calf, the body can control the exact standing attitude or posture. The distance between the central line, i.e., the point where the central line would intersect the floor, posteriorly of the central line to the rear most point of the heel of the user is defined as one segment. The naked foot naturally divides itself into approximately equal, functional, segments. The distance from the central line to the most posterior segment of the foot is about thirty percent of the total lateral length of the foot. This is one segment. From the central line to a point just behind the metatarsal heads is about one and one-half segments, corresponding to about forty-five percent lateral length of the foot. The metatarsal heads and the toes comprise slightly less than one segment, about twenty-five percent of the lateral length of the toes. The first phangie of the halix is about one-half segment. The sole of the ski boot, and the sole extension of this invention, are designed to accommodate segments relative to the naked foot.

To describe the sole construction of the boot of this invention, it is convenient to start at the back and work forward, for this is how the floor "sees" the sole during normal ambulation.

The first feature of this invention of note, proceeding in this form of the description, is that the heel of the sole extension is cut away. The heel contact point of the sole extension is approximately one-half segment forwardly of the heel of the user. The force, or torgue, placed upon the foot is a product of the weight of the step times the distance from the central line. Thus, if the sole extension is cut away, the torgue is reduced. If the cut away portion were to extend forward to the central line, then no torgue would be imparted to the foot during the heel-stride. While this would be desirable, from one sense, it would result in undesirable effects, which will be discussed later. Briefly, it would result in a less stable resting surface during normal standing.

A point one-half segment posterior to the central line is the principal contact. Selection of this principal contact point will decrease the ankle torque by about one-third of the normal ambulatory value. The decrease of ankle torque is to less than one-half the original torque because the heel of the standard ski boot extends far beyond the naked heel. This means that one-half segment behind the central line will be about one-third of the distance to the most posterior point on the boot. Cutting the heel further will cause instability while standing.

It would be desirable for all soles to be of equal heights. This would make adjusting the skiis from boot to boot far simpler. It appears, however, that three standard heights would be feasible and desirable; one for men, one for women, and a children's size. This would be important only in determining the block height on the skiis to permit the boot to be properly secured to the skis. It should be noted at this point that any type of ski binding may be used with this invention. Only the height about the ski of the binding need be adjusted.

Thickness of the sole extension can be determined from the constraints already set forth. The height of the heel - block on the ski is arbitrary, but once selected, dictates the angle of the flat second, main weight-bearing portion of the ski during skiing. This articulates with the third main weight-bearing portion during standing in a rounded manner a fixed distance of one segment anterior to the central line. It should be noted that the toes are bent up (dorsiflexed) from the metatarsal heads so that the boot may be designed more with the ankle less dorsiflexion, and the mass of the sole extension can be minimized.

Variation between different boot sizes and requirements can be compensated by the one-half segment behind the central line. The slope and degree of curvature in this segment is not critical. It can, therefore, act as a connector between the heel contact point, in which height is critical, and the flat, sloping segment immediately anterior to the central line, i.e., the standing surface. The height here is determined by its mandated angle perpendicular to the central line, and the surface inersect with the next flat segment. The slope and degree of curvature from under the metatarsal heads to the toe of the boot is not critical.

The normally walking individual's leg forms an angle of about sixty-five degrees to the floor during the heel strike. The military calculates that during a forced-march, this angle approaches forty-seven degrees and the military tests the boots accordingly. An angle of sixty degrees has been selected for the walking ski boot of this invention such that it will have its heel contact points so that user's leg will be at an angle of about sixty degrees with the floor. This would allow for a comfortably long stride. If this user stretches his stride further, the back of the boot may strike the floor. This is compensated for by providing a soft non-skid rubber surface on the back of the boot. This is largely simply an abundance of caution, but is considered a feature of the invention. The second effect is that the high ankle torgue previously mentioned will be invoked to rotate the boot onto the floor, thus aiding greatly in preventing slippage and falls.

The one-half segment between the heel contact point and the central line is rounded to ease the progression of the body weight forward. It is also lower laterally than medially, with slight rounding in that plane. That is, this portion of the sole extension is generally arcuate, (not necessarily part of a circular arc) being curved in two dimensions, laterally and longitudinally. The purpose of this angulation is to cause the foot to stride in a valgus, pronate position. Thus the sole is leveled, medially and laterally equal, at the central line, the boot and foot will be forced to supinate as the weight progresses forwardly. This supination will compensate for the natural rotation of the hip during normal ambulation.

The next segment is medially-laterally leveled, i.e., is substantially flat and is generally parallel to the keel of the ski boot such that during standing, a line perpendicular to the floor passes through the center of this resting surface, this segment, and through the center of the knee.

Progressing to the next segment, this surface is designed to support the ski boot on the ski and is generally flat and at an angle to the keel of the boot. It is preferably slightly longer on the medial side of the boot than the lateral. The purpose of this segment is to provide solid support while skiing. In combination with heel and toe posts, rigid control of the ski is achieved of acceptable strength for all but the most advanced competition skier. Those few skiers who desire additional control strength can place additional blocks upon their skis so as to support the sole extension on the ski along much of its length.

In mounting this ski boot onto the ski, the heel post is a block mounted on the ski to fit under the heel cut away portion and give support while skiing. The toe post is an analogous block placed under the cut away under the toes. Thus, the heel, the toes and the metatarsal of the user's foot are supported directly by the ski, during skiing.

Thus, reviewing very briefly, as the user walks, the rear most or fourth portion of the bottom of the sole is contacted, being cut away so as to be about one-half segment forwardly of the rear of the heel of the user, the force vector of the user's weight moves forwardly and medially to about the center and then moves forwardly along a line generally along the center of the body as the user walks further, and, finally, as the user moves off the boot, the force vector of the user's weight moves forwardly and medially toward the medial side of the user's foot underneath the first phalanx.

During normal standing, the vector point falls between the central line and the metatarsal heads. This is virtually all of the time when an individual is standing, therefore, if no support were provided posterior to the central line, then most of the time there would be no problem. However, if the user tended to tip back, if the weight were ever to fall behind the central line, there would be some instability because the ankle is firmly fixed and weighted by the boot. and the ability of the user to recover is greatly diminished. By placing the initial contact point one-half segment behind the central line, a firm platform is provided for those rare instances when the vector point may fall behind the central line and, therefore, there is an opportunity to recover before falling.

With these design and function criteria in mind, reference will be made to the drawings and to the preferred embodiment of the invention, with the understanding that this is simply a preferred embodiment. The invention can be made of any material of suitable physical characteristics, and can be made in many different shapes and a virtually infinite variety of sizes, so long as the principles described are followed, without departing from the intent and scope of the invention.

Modern ski boots are frequently made in an essentially unitary construction. The manufacturing process is sometimes accomplished in steps but the end result is often a ski boot comprised of a polymeric material in which the uppers and the sole are substantially integral one with another. In the embodiment depicted here as exemplary, this construction is adopted. It should be understood, clearly, however, that the soles may be made of one plastic, or of leather, and the uppers made of another plastic, or of leather, or of some other material. Commonly used plastics, i.e., polymeric materials, such as the polyvinyl polymers and copolymers, polycarbonate polymers and copolymers, and others, may be used, as is traditional in the industry at the current time. Thus, the materials of which the ski boot of this invention is made is of no consequence particularly so long as the configuration described and claimed is reasonably adhered to.

Figure 2:
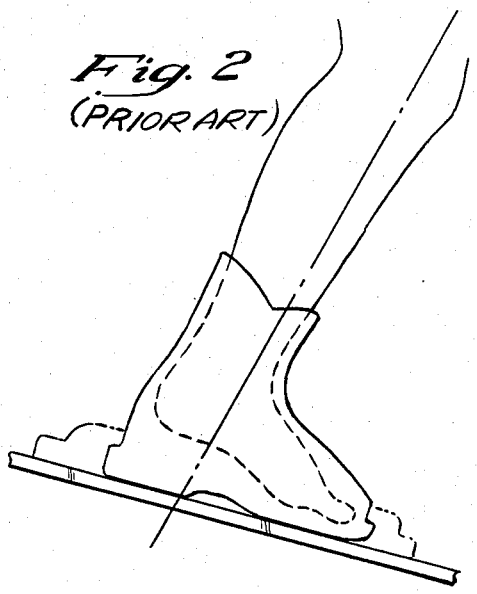
Fig. 2 (PRIOR ART)
FIG. 2 is a depiction of a prior art ski boot, as shown in FIG. 1, showing the configuration during skiing.

FIG. 1 and FIG. 2 show a typical prior art ski boot, in largely schematic depiction showing the position during walking and during skiing. During skiing, the user's knees are bent to some degree and he skis in a crouch or partially crouched position. The ski boot is designed to provide this feature. During walking, however, the knees ae traditionally straight, except during taking the stride, and, therefore, the traditional ski boot puts unusual forces on the user's legs, ankles and fee.

Figure 3:
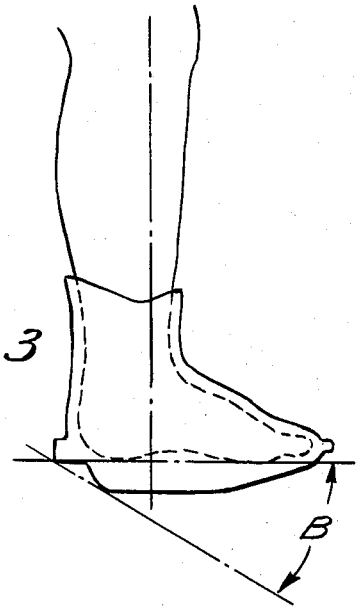
FIG. 3 is a schematic depiction of the present invention, being used in the walking mode.

FIG. 3 shows the boot of the present invention in largely schematic form, during walking and shows that the force factor which extends through the knee of the user is substantially perpendicular to the floor or ground when the user is standing. This, of course, is the usual and proper standing position.

Figure 4:
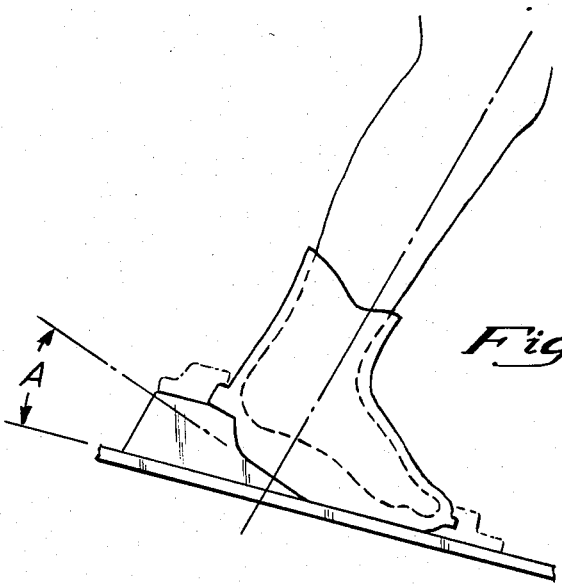
FIG. 4 is a schematic depiction of the present invention being used in the skiing mode.

FIG. 4 depicts the boot of this invention, in schematic form, lash to a ski showing that, during skiing, the knee is bent, as is the proper skiing posture. It will be noted that the toes are slightly flexed. While not critical to the major advantages of the invention, this is a very important feature. While presenting a very minor discomfort when walking, this feature makes for great comfort and control during skiing. The under-side of the foot at the metatarsal head and of the toes is generally parallel to the plane of the first portion 110 of the boot sole, in the preferred form, though total parallelism is not compelled.

It will be apparent from a consideration of FIGS. 1 through 4 that the problems of the prior art, in which it was impossible to provide a proper skiing configuration and a proper walking configuration in the same boot have been overcome by the present invention in which the boot permits the user to both walk and ski with his legs in the proper position for each of these differing activities.

Figure 5:
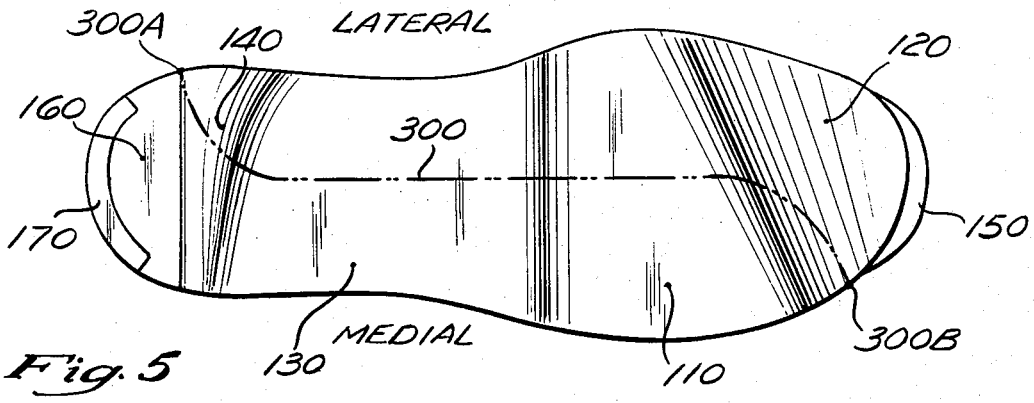
FIG. 5 is a bottom view of the configuration of the sole.

Referring to FIG. 5, the sole of this boot is divided, for convenience of discussion, into six different portions. The first portion is designated generally at 110, in FIG. 5, the second at 120, the third at 130, the fourth at 140, these being the major functional configurations of this invention. In addition, a cleat portion 150 in the front, a cleat portion 160 in the back, and a soft bumper portion 170 on the corner of the heel portion, are provided.

Referring to FIG. 6, the ski boot of this invention is adapted to be used with a traditional ski 200 with a toe block and also includes a heel block 220 which, preferably, includes a wedge portion 222 which fits under the third portion 130 of the sole of the boot. In addition, of course, ski bindings will be provided, but these are not shown for clarity of illustration and because they constitute no part of the present invention, conventional ski bindings being quite suitable for the present invention.

Reference is now made to FIG. 7 which shows the present invention, in cross-section, in somewhat greater detail.

The first portion, indicated at 110, is usually generally flat and is adapted to rest directly upon the top of the ski. The first segment 110 lies under the metatarsal head of the user. It is in this area that the weight of the user is concentrated during skiing, although by use of the block 222, the weight of the user may be spread along substantially the full length of the foot. In either event, of course, the weight of the user is also supported at the toe and the heel by the blocks 210 and 220, as previously discussed. The first portion provides control of the ski by the user in cooperation and interaction with the bindings and the toe and heel support blocks.

Extending forwardly of the first portion is the second portion 120 of the sole, i.e., that portion formed on the sole extension which carries the weight of the user as the user is walking forward and transferring weight to the other foot during normal ambulation. The second portion slopes in an arcuate configuration medially of the user's foot and forwardly from the first portion, i.e., in a double-curved surface, or double arcuate surface now being curved or arcuate forwardly and, as best shown in FIG. 5, and is curved or arcuate medially as best shown in FIGS. 5 and 10. The second portion 120 intersects with the first portion 110 at a point below the metatarsal head and, preferably, just forward of the metatarsal head of the user's foot and continues to the forward end of the toe of the user, or slightly beyond.

The third, or resting surface portion of the boot 130 is in a generally flat configuration sloping rearwardly from the first portion upwardly toward the heel of the upper body at least to a point approximately under the medial malleolus of the user's ankle. It is upon this portion that the user stands while not skiing, i.e. on the floor during use.

The fourth portion 140 slopes in an arcuate or curved configuration laterally of the user's foot and also in a curved or arcuate configuration rearwardly of the user's foot from the third portion toward the real of the upper such that, in use, the fourth portion normally strikes the floor first when the user is walking. The four portions of the bottom form a continuous surface constructed and configured such that the user's foot rolls, first medially from the point of striking, on the fourth portion 140 to the third portion 130 and then generally centrally along the third and first portions 130 and 110 and then rolls medially on the second portion 120 as the user walks.

The rear most end of the third portion lies, in the preferred embodiment, approximately one-half the distance from the tip of the user's heel to a point lying directly between the medial malleolus of the user's ankle, i.e., about one-half the distance from the tip of the user's heel to the central line.

The front most end of the first portion lies anteriorially of a point directly beneath the metartarsal head of the user's foot, when in use.

The first portion and the third portion are generally planer forming an angle A, see FIG. 4, between the planes of the first and third portions. Angle A is generally from about five degrees to about fifteen degrees, usually about ten degrees. This angle A may, however, be as high as about thirty degrees for certain professional skiers who desire a greater bend in the knee during skiing.

Angle B is defined by a plane approximating the sole of the user's foot and a line drawn from the rear most tip of the ski boot sole to the point at which, during walking by the user, the sole by the contacts the floor and the rear tip of the boot, see FIG. 3. This angle B is generally about 30 degrees plus or minus about 8–10 degrees. While this angle is relatively critical, some reasonable variation is permitted. In a preferred embodiment, the angle B is about 30 degrees.

Reference is made to FIGS. 8, 9 and 10, respectively, which show the principal structures which have been described. FIG. 8 depicts the double curve fourth portion 140 and the resting portion 130. FIG. 9 depicts the first portion 110, which is used to support the ski boot on the ski, and, in phantom line, the curve at the forward end of the body defined by the portion 120, this curve being shown also in FIG. 10.

FIG. 5 is a view of the bottom of the sole of this invention. showing the line 300 traversed by the vector point during normal ambulation. The strike point 300A is on the lateral side of the user's foot and, of course, the force is initially concentrated at that point. As the user walks, the vector point moves forwarding and, because of the curvature, moves medially toward the center of the sole extension block where it follows along about the center during the middle part of the stride. As the stride begins to leave the middle part of the foot, anterior of the metatarsal head, the vector point moves further medially and eventually terminates at a point 300B on the medial side of the foot, just under the big toe of the user.

This rather complex configuration of the sole has a number of very significant advantages. It permits less strenuous walkiing because the line traversed by the vector point during walking is shorter, traversing from a point well inside the heel of the user to a point posterially to the tip of the toe of the user. Thus, it takes a great deal less energy and it is very much less tiring.

The natural rotation of the hip during normal ambulation is compensated for by the design of the sole extension of this invention, making walking safer, more stable, and less tiring, with less stress upon the body structures.

The ankle torques are decreased to about one-third the normal ambulatory values one would otherwise experience, and the user is more quickly brought to rest upon the third or resting portion of the sole giving better footing and more stability.

The forces exerted on the calf of the leg are relieved during standing, as well as during walking, and the user is permitted to walk with a longer and more natural gait then would otherwise be possible. The anterior muscles of the leg are thus relieved during skiing due to the decreased dorsisflexion of the ankle.

Only modest adjustment of ski binding is necessary to permit attachment of the boot to the ski and, during skiing, the user has great control which can be increased, if desired, by simply adding a wedge-shape block under the resting portion of the sole extension.

These and the general advantages of a more relaxing, comfortable walking, coupled with ease of attachment and release from the skiis, make the prsent invention a very significant advance in the art.

It will be recognized that within the concept, principles, and approaches taught by this invention, considerable variation may be introduced without departing from the scope of the invention.

What is claimed is:

1. A ski boot having a relatively rigid sole structure and an upper structure for receiving the foot of the user, the sole being elongate having a length and a width generally corresponding to the length and width of the user's foot and having formed on the bottom thereof four portions, as follows: (a) a first portion adapted to rest on the top of a ski during skiing, said first portion being generally flat and lying approximately under the metatarsal and forward toward the toes of the user's foot when the user is skiing; (b) a second portion sloping in an arcuate configuration medially of the user's foot forwardly from the first portion and upwardly proximate the tip of user's toes during skiing; (c) a third portion sloping in a generally flat configuration rearwardly from the first portion toward and upwardly toward the user's heel at least to a point approximately under the medial malleolus of the user's ankle; and (d) a fourth portion sloping in an arcuate configuration laterally of the user's foot rearwardly and upwardly toward the heel of the user such that when the user walks the fourth portion normally strikes the floor first; the four portions of the bottom forming a continuous surface constructed and configured such that the center of force applied during walking moves laterally on the fourth portion to the third portion, centrally along the third and first portions, and medially on the second portion.

2. The boot of claim 1 wherein the rearmost end of the fourth portion is one-half the distance from the tip of the user's heel to a point lying directly below the medial malleolus of the user's ankle, in use.

3. The boot of claim 1 or 2 wherein the frontmost end of the first portion lies under the toes of the user's foot and wherein the toes of the user are bent upwardly by the sole during skiing and during walking.

4. The boot of claim 1 wherein the first and third portions are generally planar and the angle (A) between the planes of said portions is from about five degrees to about fifteen degrees.

5. The boot of claim 1 wherein the rearmost end of the fourth portion lies approximately one-half the distance from the tip of the user's heel to a point lying direct beneath the medial malleolus of the user's ankle, in use, and the first portion extends posteriorly from proximate the point directly beneath the user's toes to a point posteriorly of the metatarsal head.

6. The boot of claim 5 wherein the frontmost end of the first portion lies under the toes of the user's foot and wherein the toes of the user are bent upwardly by the sole during skiing and during walking.

7. The boot of claim 5 wherein an angle (B), defined by the plane of the sole of the user and a line drawn from the rearmost tip of the ski boot sole to the point at which, during walking by the user, the body contacts the floor, is 30 degrees, plus or minus about 10 degrees.

8. The boot of claim 6 wherein angle (B) is about thirty degrees.

9. The boot of claim 7 wherein the first and third portions are generally planar and the angle (A) between the planes of said portions is from about five degrees to about fifteen degrees.

10. The boot of claim 9 wherein the frontmost end of the first portion lies posteriorly under the toes of the user's foot and wherein the toes of the user are bent upwardly by the sole during skiing and during walking.

11. The boot of claim 1 wherein an angle (B), defined by the plane of the sole of the user and a line drawn from the rearmost tip of the ski boot sole to the point at which, during walking by the user, the body contacts the floor, is 30 degrees, plus or minus about 10 degrees.

12. The boot of claim 9 wherein angle (B) is about thirty degrees.

13. The boot of claim 10 wherein the first and third portions are generally planar and the angle (A) between the planes of said portions is from about five degrees to about fifteen degrees.

14. The boot of claim 13 wherein the frontmost end of the first portion lies posteriorly under the toes of the user's foot and wherein the toes of the user are bent upwardly by the sole during skiing and during walking.

* * * * *